US011217122B2

(12) United States Patent
Sagidullin

(10) Patent No.: US 11,217,122 B2
(45) Date of Patent: Jan. 4, 2022

(54) LIGHT REFLECTING DECORATIVE PANEL

(71) Applicant: Denis Sagidullin, Krasnodar (RU)

(72) Inventor: Denis Sagidullin, Krasnodar (RU)

( * ) Notice: Subject to any disclaimer, the term of this patent is extended or adjusted under 35 U.S.C. 154(b) by 0 days.

(21) Appl. No.: 16/971,511

(22) PCT Filed: May 4, 2020

(86) PCT No.: PCT/RU2020/050088

§ 371 (c)(1),
(2) Date: Aug. 20, 2020

(87) PCT Pub. No.: WO2021/061012

PCT Pub. Date: Apr. 1, 2021

(65) Prior Publication Data

US 2021/0335150 A1 Oct. 28, 2021

(30) Foreign Application Priority Data

Sep. 24, 2019 (RU) ..... RU2019129914

(51) Int. Cl.
*G09F 7/06* (2006.01)
*G09F 19/02* (2006.01)
*G09F 13/16* (2006.01)

(52) U.S. Cl.
CPC ..... *G09F 7/06* (2013.01); *G09F 13/165* (2013.01); *G09F 19/02* (2013.01)

(58) Field of Classification Search
CPC ..... G09F 7/09; G09F 13/165; G09F 19/02
See application file for complete search history.

(56) References Cited

U.S. PATENT DOCUMENTS 1,708,028 A * 4/1929 Pancoast ..... G09F 13/165 40/613
3,043,039 A * 7/1962 Battaglia ..... G09F 13/16 40/613
3,166,863 A * 1/1965 Gray ..... G09F 13/16 40/613
3,189,183 A * 6/1965 Warrent ..... G09F 7/22 211/13.1
3,202,288 A * 8/1965 Warrent ..... G09F 13/16 211/13.1
3,206,882 A * 9/1965 Thatcher ..... G09F 13/16 40/613

(Continued)

*Primary Examiner* — Gary C Hoge
(74) *Attorney, Agent, or Firm* — Nadya Reingand; Yan Hankin

(57) ABSTRACT

A reflective decorative panel comprises a base implemented as a module of the panel, the base having restraining members on which reflective elements are arranged. The base is configured as a lattice framework having longitudinal and transverse bearing stripes, and the restraining members comprise rods each having a restraining head and used for accommodating the reflective element. The restraining head has a tapered shape towards its free end, and the restraining members are casted integrally with the base. At edge portions of the base, support members are provided with connection slots for connecting modules. The restraining members comprise the support members, and the support members have inner longitudinal cavities in which the rods with the restraining heads are provided. The restraining head comprises a vertical slot used for putting on the movable reflective element.

14 Claims, 22 Drawing Sheets

(56) References Cited

U.S. PATENT DOCUMENTS

| | | | | | |
|---|---|---|---|---|---|
| 3,260,372 | A * | 7/1966 | Jauslin | G09F 13/16 | 211/13.1 |
| 3,298,123 | A * | 1/1967 | Ownbey | G09F 13/16 | 40/613 |
| 4,017,992 | A * | 4/1977 | Kajitani | G09F 13/16 | 40/439 |
| 4,080,747 | A * | 3/1978 | Kato | G09F 13/165 | 40/613 |
| RE30,822 | E * | 12/1981 | Kato | G09F 13/165 | 40/613 |
| 4,308,680 | A * | 1/1982 | Aboudi | G09F 13/16 | 40/447 |
| 9,601,038 | B2 * | 3/2017 | Shwed | G09F 13/165 | |
| 9,792,841 | B2 * | 10/2017 | Cowan | F16B 5/0056 | |
| 2011/0287207 | A1 * | 11/2011 | Shwed | G09F 13/165 | 428/53 |
| 2012/0182207 | A1 * | 7/2012 | Cowan | G09F 7/06 | 345/55 |
| 2014/0168983 | A1 * | 6/2014 | Opsomer | H05K 13/0015 | 362/249.07 |
| 2015/0199925 | A1 * | 7/2015 | Pulos | G09F 7/06 | 40/594 |
| 2018/0374404 | A1 * | 12/2018 | Ainge | G09F 19/16 | |

* cited by examiner

H-H

K-K

LIGHT REFLECTING DECORATIVE PANEL

FIELD OF THE INVENTION

The invention relates to the field of design presentation, advertising and building industry, and particularly to apparatuses for displaying images when reflecting light radiations used to manufacture a wide range of display works, advertising signboards, panels, billboards, and the like.

BACKGROUND OF THE INVENTION

U.S. Pat. No. 4,017,992 (19 Apr. 1977) discloses a decorative panel intended for color transfer and reflection of light radiations, which is configured as a movable reflective disc attached to a base sheet in cantilever fashion. The thick base sheet has grooves intersecting at a right angle, thereby forming numerous individual squares on the surface of the base sheet. The base sheet has fixing holes, and cylindrical supports for fixing the movable disc which are fastened on the base sheet, each support having an upper part.

Discs are held in an installation position on the base sheet by using rivets inserted in the cylindrical supports and fastened on the base sheet. The rivets pass through rectangular holes in the discs along a longitudinal axis of the cylindrical support. A lower end of each rivet is retained in a bottom part of the base sheet.

The drawback of the decorative panel disclosed in U.S. Pat. No. 4,017,992 is its assembly complexity: it uses complicated cantilever mounting based on the rivets inserted in the cylindrical supports and fastened to the base sheet.

EA005385 (24 Feb. 2005) discloses an apparatus for displaying moving images, including a common base having a plurality of cantilever members arranged thereon. A flat rigid plate is fixed on a free end of each of the cantilever members such that the plate may carry out an oscillatory or reciprocating movement relative to its fixing point due to external effects on its surface. Surfaces of such plates are decorated with image fragments, with each plate being a carrier of a separate image fragment. These carriers of the image fragments are arranged on the common base such that they constitute the whole image. A part of the cantilever members is combined into a module configured to be fastened on the common base.

The apparatus disclosed in EA005385 has the same drawbacks as the decorative panel disclosed in U.S. Pat. No. 4,017,992, namely it uses the complicated cantilever mounting which complicates its assembly process.

RU152342 discloses a reflective decorative panel comprising a base, means for fixing movable reflective elements which are configured as rods of variable longitudinal cross-section, wherein the movable reflective elements are put on the rods. The base is configured as a plastic lattice framework consisting of a frame and longitudinal and transverse bearing stripes. The means for fixing the reflective elements are installed on the longitudinal stripes of the framework in fixing points.

The decorative panel disclosed in RU152342 has the following drawbacks:

Its assembly process consists of the following steps:

1) The movable reflective element is put on the rod.
2) The rods with the movable reflective elements are inserted in their fixing points which are configured as mounting holes in support members. The rod is forcefully fixed in the support member.

The base of the panel is made, as a rule, of rigid and technology-intensive polymer materials, such, for example, as ABS plastic or polycarbonate, which require high heating-up temperature and long cooling time. If there are minor changes in these casting parameters, an end item will have a distortion which may result, in some cases, in occurring the shrinkage of the base dimensions. All these properties have a sufficiently strong influence on the final quality of the item.

RU182951 discloses a reflective decorative panel comprising a base implemented as a module of the panel and configured to be connected to other modules. The base is implemented as a plastic lattice framework consisting of a frame and longitudinal and transverse bearing stripes. The framework comprises cantilever members which have movable reflective elements arranged thereon in cantilever fashion. The cantilever members are made integrally with the framework, and each cantilever member consists of a rod, a head and a body. The bodies of the cantilever members arranged on the frame have, along the perimeter of the framework, seat members arranged on the reverse side of the framework. The reflective decorative panel have connection elements arranged on the sides of the framework in order to enable connection with other frameworks. The frame of the framework has connection elements casted integrally with the panel itself and used to connect with other frameworks. The connection elements are made as an all-cast bar provided with a seat member on its free end, the seat member being connected with a different seat member in a body of a different framework.

The closest technical solution is disclosed in RU patent application 182951. Being an outdoor advertisement, a reflective decorative panel may be suspended, for example, on cantilevers, hooks, and the like. It may be rigidly or pivotally attached to supporting structures, walls, balconies, or other structural elements of buildings, constructions, and/or engineering equipment. Therefore, an important factor is a reduction in the weight of such advertising structure. To improve the reflective decorative panel disclosed in RU182951 in this regard, the present author has paid special attention to the cantilever member as it is the most weighting member of the decorative panel.

The present author has experimentally found that the weight of the framework of the reflective decorative panel may be generally reduced by using all-cast cantilever members, each with a support member configured to have an inner longitudinal cavity in which a rod having a restraining head and used for accommodating a movable reflective element is inserted. The restraining head comprises a vertical slot additionally reducing the weight of the whole item.

One technical result of the present invention consists in creating a decorative panel having a base whose structure provides a reduction in its weight.

Another technical result of the present invention is a simplification of an assembly process, a reduction in the time required to assemble the decorative panel, as well as a reduction in the strain occurring during the assembly process.

SUMMARY OF THE INVENTION

The technical results are achieved by a reflective decorative panel according to embodiment 1, which comprises a base implemented as a module of the panel, the base having restraining members on which movable reflective elements are arranged in cantilever fashion by using holes. The base is configured as a plastic lattice framework having longitudinal and transverse bearing stripes. The restraining members comprise rods each having a restraining head and used for accommodating the reflective element. The restraining head has a tapered shape towards its free end, and the restraining members are casted integrally with the base on the bearing stripes. At edge portions of the base, support members are provided with connection slots for connecting different modules. According to the invention, the restraining members comprise the support members, and the support members have inner longitudinal cavities in which the rods with the restraining heads are arranged. The rods are spaced apart from or connected to walls of the support members by means of at least one reinforcement rib. The restraining head comprises a vertical slot used for accommodating the movable reflective element, the movable reflective element having a hole whose size is equal to a size from a face end of the slot to a diametrically opposite base edge of the restraining head.

Further, the size of the hole of the movable reflective element corresponds to the size from the face end of the vertical slot of the restraining head to the diametrically opposite base end of the restraining head.

Furthermore, the size of the tapered part of the restraining head is less than the size of the hole of the movable reflective element.

Furthermore, connection elements, which are configured as bars each casted integrally with the base and provided with a pin at the end of the connecting element, are provided on the reverse side of the base of the panel at the locations of the rods.

Furthermore, the support members are provided, at the edge portions of the base, with connection slots for connecting the modules.

Furthermore, the reflective decorative panel comprises a duplicating base that is a plane having a monochromatic or polychromatic image provided thereon.

Furthermore, the reflective decorative panel comprises lock members inserted in the cavity of the support element to fasten the duplicating base.

Furthermore, the reflective decorative panel comprises suspensions for hanging the assembled panel to a vertical plane.

The technical results are also achieved by a reflective decorative panel according to embodiment 2, which comprises a base implemented as a module of the panel, the base having restraining members on which movable reflective elements are arranged in cantilever fashion by using holes. The base is made of solid monolithic plastic. The restraining members comprise rods each having a restraining head and used for accommodating the reflective element. The restraining head has a tapered shape towards its free end, and the restraining members are casted integrally with the base. At edge portions of the base, support members are provided with connection slots for connecting different modules. According to the invention, the restraining members comprise the support members, and the support members have inner longitudinal cavities in which the rods with the restraining heads are arranged. The rods are spaced apart from or connected to walls of the support members by means of at least one reinforcement rib. The restraining head comprises a vertical slot used for accommodating the movable reflective element, the movable reflective element having a hole whose size is equal to a size from a face end of the slot to a diametrically opposite base edge of the restraining head.

Furthermore, the size of the hole of the movable reflective element corresponds to the size from the face end of the vertical slot of the restraining head to the diametrically opposite base end of the restraining head.

Furthermore, the size of the tapered part of the restraining head is less than the size of the hole of the movable reflective element.

Furthermore, connection elements, which are configured as bars each casted integrally with the base and provided with a pin at the end of the connecting element, are provided on the reverse side of the base of the panel in the support members of the restraining members.

Furthermore, the support members are provided, at the edge portions of the base, with connection slots for connecting the modules.

Furthermore, the reflective decorative panel comprises a duplicating base that is a plane having a monochromatic or polychromatic image provided thereon.

Furthermore, the reflective decorative panel comprises lock members inserted in the cavity of the support element to fasten the duplicating base.

Furthermore, the reflective decorative panel comprises suspensions for hanging the assembled panel to a vertical plane.

LIST OF REFERENCE NUMERALS

1—base;
2—movable reflective element;
3—restraining member;
4—longitudinal bearing stripes of a framework;
5—transverse bearing stripes of the framework;
6—support member;

7—cavity;
8—reinforcement rib;
9—rod;
10—restraining head;
11—slot of the restraining head;
12—connection element;
13—pin;
14—connection bar;
15—fixing hole;
16—connection slot for the connection bar 12, 14;
17—lock member;
18—suspension;
19—inner hole of the movable reflective element;
20—duplicating base;
21—hole of the duplicating base;
22—hole of the suspension 18;
23—vias; and
24—flash.

DETAILED DESCRIPTION OF THE INVENTION

Embodiment 1

Figure 1:
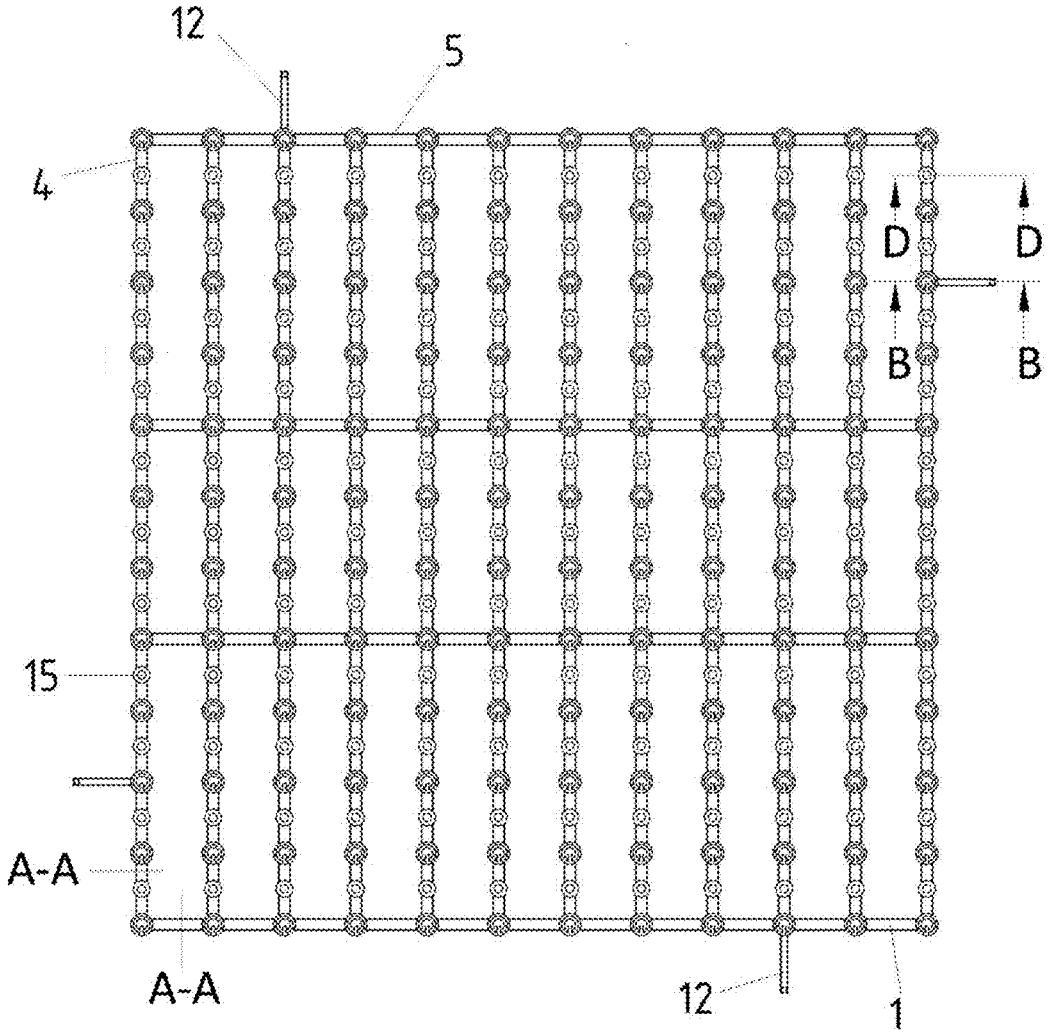
FIG. 1 shows a panel base in the form of a framework according to embodiment 1.

A reflective decorative panel according to embodiment 1 consists of a base 1 represented by a lattice framework constituted by intersecting stripes 4, 5 (see FIG. 1). The lattice framework is made of transparent polymer material, such as high-impact polystyrene, acrylic glass, monolithic polycarbonate, by means of pressure casting.

Figure 20:
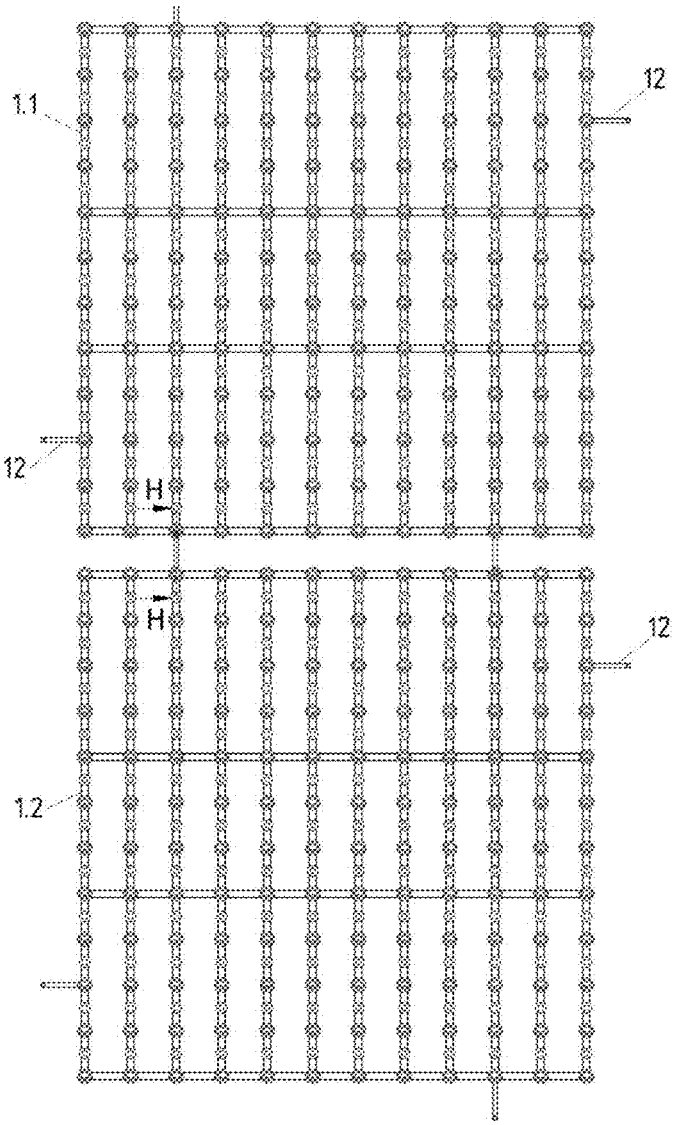
FIG. 20 shows a scheme for connecting the modules 1.1 and 1.2.

The base 1 is a module which may be connected to other modules by using connection elements 12 (see FIG. 20). Movable reflective elements 2 (see FIG. 3) are arranged on restraining members 3 of the framework 1 in cantilever fashion with the aid of holes 19. The holes 19 of the movable reflective elements 2 may have any geometric shape, namely: a circle, semi-circle, oval, polygon, etc.

The movable reflective elements 2 are made of biaxially oriented polyester material with thickness 150-200 microns. This material has a high elasticity, a possibility of being subjected to repeated strain, an excellent primary manufacturing memory, and a recoverability of its physical properties. The physical properties, such as thickness, density, linear stiffness, are changed in this material only under high temperatures starting from 200 degrees (see http://new-chemistry.ru/letter.php?n_id=1113).

Figure 3:
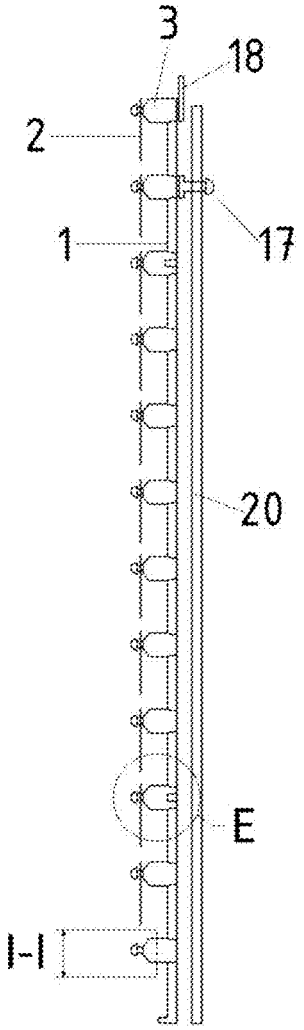
FIG. 3 shows a block diagram of an assembled panel according to embodiments 1 and 2.
Figure 4:
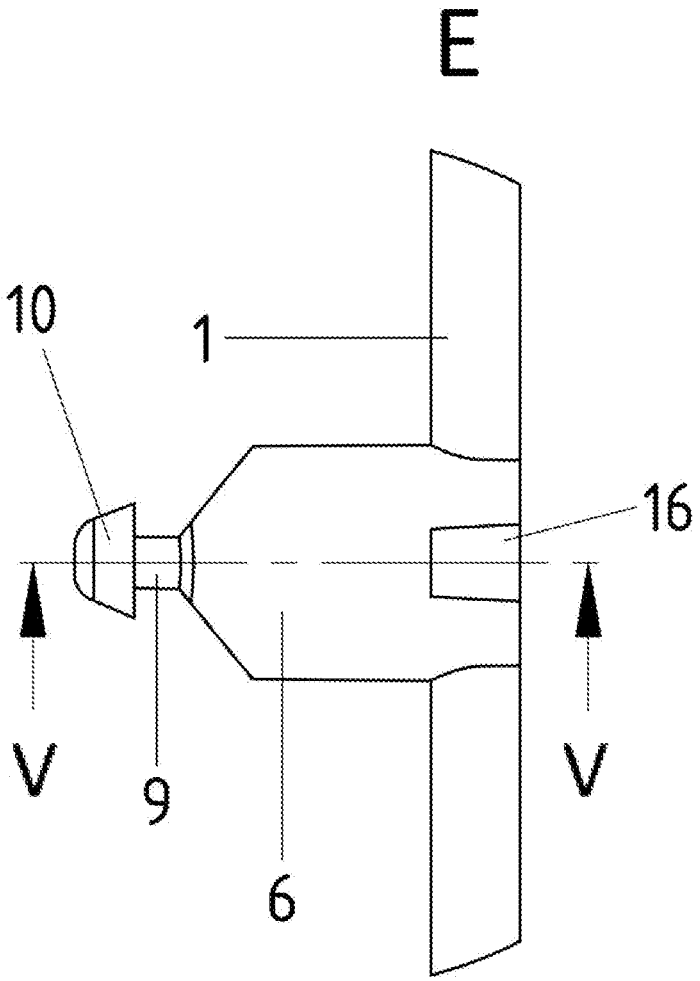
FIG. 4 is view E in FIG. 3.

The framework 1 consists of the longitudinal 4 and transverse 5 bearing stripes with the restraining members 3 for the movable reflective elements 2 arranged thereon (see FIGS. 3, 4).

Figure 5:
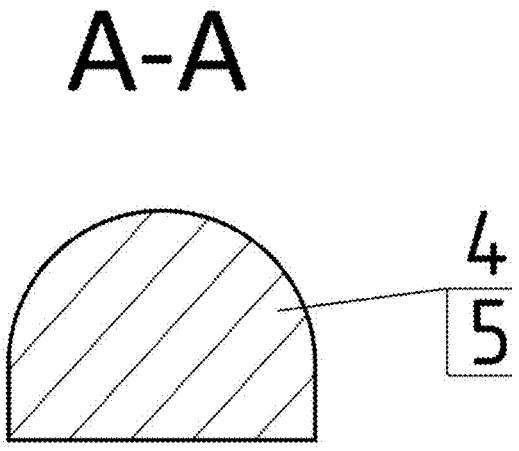
FIG. 5 is a section along line A-A in FIG. 1.

The stripes 4 and 5 are bars which preferably have a semicircular cross-section (see FIG. 5). This cross-section is selected to avoid light refraction when an item is viewed from the side, since an end glow effect occurs in case of a rectangular cross-section when light rays pass through bar faces. In the meantime, the semicircular bar produces an effect of projecting, onto itself, the same color as the one on which the bar is laid down when it is connected to a duplicating base 20 (see FIG. 3). A lens effect is provided—i.e. color is projected onto an upper layer of the bar, thereby increasing an effect from an image on the duplicating base 20 and hiding the presence of the lattice framework over the image. However, in other embodiments, it is feasible to manufacture bars of rectangular cross-section, trapezoidal cross-section, etc.

Figure 6:
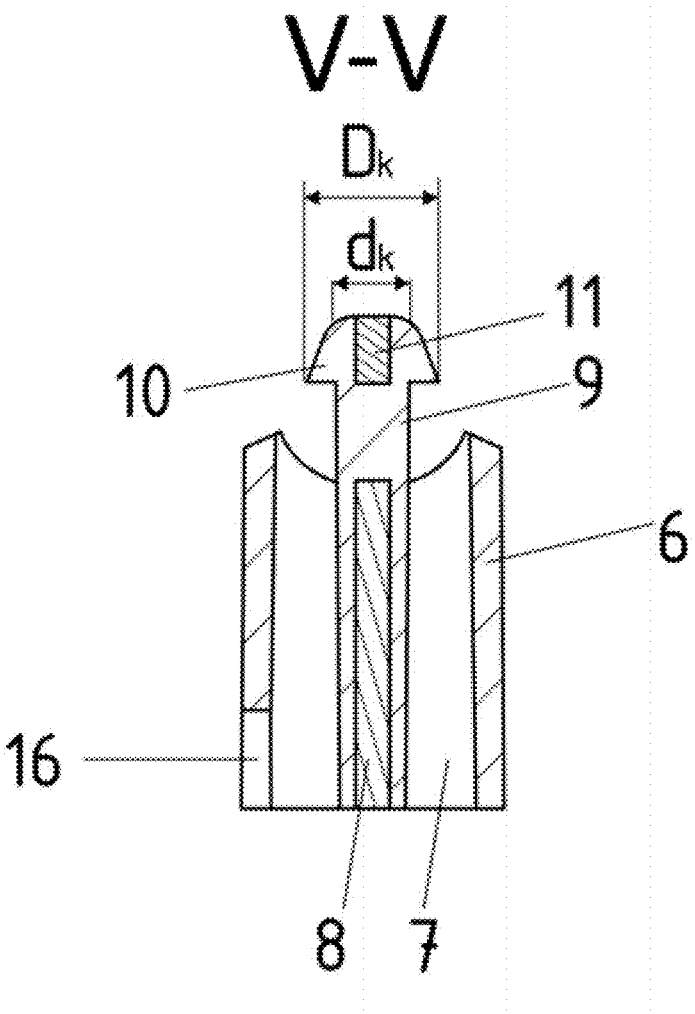
FIG. 6 shows a restraining member 3, i.e. its section along line V-V in FIG. 4.
Figure 7:
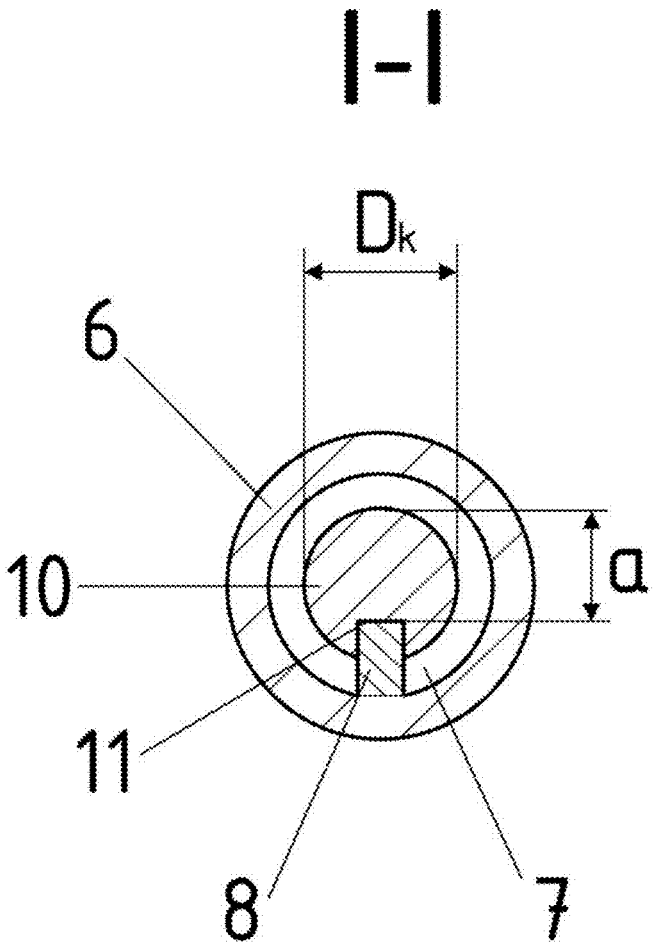
FIG. 7 shows the restraining member 3, i.e. its section along line I-I in FIG. 3.

The restraining members 3 (see FIGS. 4, 6) are arranged on the bearing stripes 4 and 5 and consist of support members 6 having inner longitudinal cavities 7 in which rods 9 with a restraining head 10 for accommodating the movable reflective elements 2 are provided. The rods 9 are spaced apart from or connected to walls of the support member 6 by means of at least one reinforcement rib 8 (see FIGS. 6, 7, 8, 9, 10).

Figure 8:
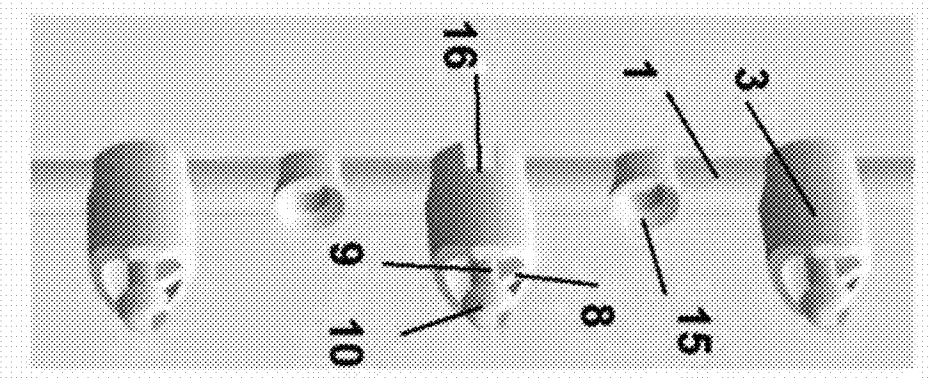
FIG. 8 shows a side view of a fragment of a framework 1 with the restraining members 3.
Figure 9:
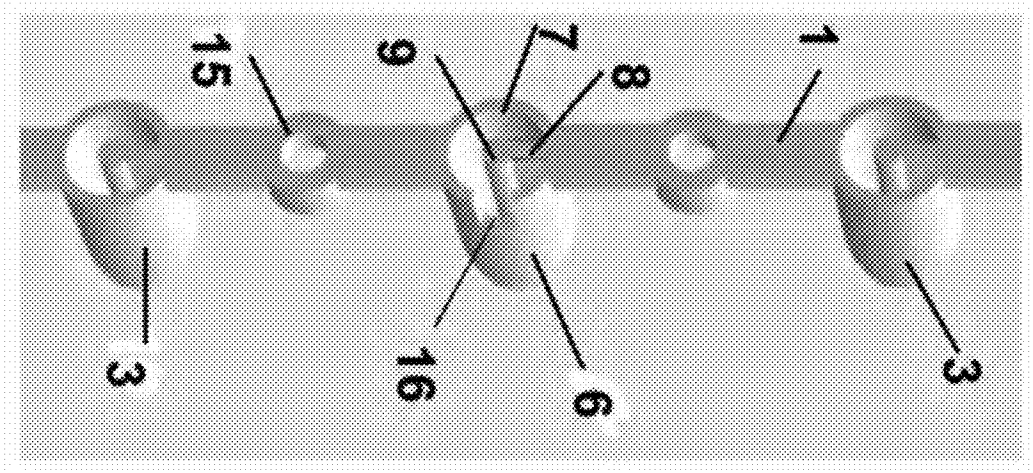
FIG. 9 shows a back view of the fragment of the framework 1 with the restraining members 3.

The support members 6 are provided, at edge portions of the base, with connection slots 16 for connecting the modules (see FIGS. 4, 8, 9).

The restraining head 10 used for restraining the movable reflective element 2 from falling is provided on the side of a free end of the rod 9. The restraining head 10 has a frustoconical shape and comprises a vertical slot 11 (see FIGS. 6, 7). The presence of the slot 11 provides a reduction in the weight of both the restraining head and the framework as a whole.

Figure 13:
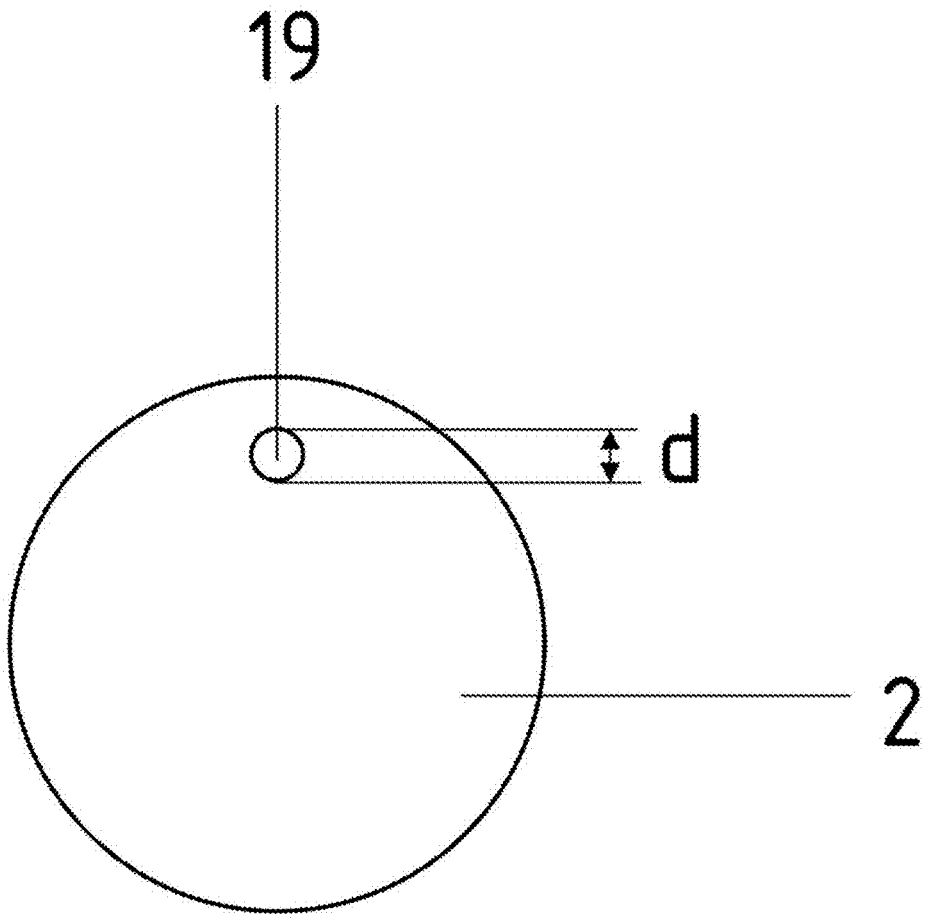
FIG. 13 shows a movable reflective element.

Furthermore, the present author has found that such a shape of the restraining head 10 facilitates quick installation of the movable reflective element 2 on the rod 9, without causing strains and extensions of the reflective elements. This is because the size d of the hole 19 of the movable reflective element 2 (see FIGS. 6, 13) is equal to the size a from the face end of the slot 11 to a diametrically opposite base edge of the restraining head 10, where:

Dk is the diameter of a base of the restraining head;

dk is the diameter of an end portion of the restraining head;

a is the distance from the external circle Dk to the slot 11.

The smaller diameter dk of the outer part of the restraining head is smaller than the size of the hole 19 of the movable reflective element 2. This is done in order to position the workpiece with the perforated reflective elements 2 as accurately as possible with respect to the rods 9 when assembling the decorative panel. The larger diameter Dk of the base of the restraining head 10 serves as a lock member for the movable reflective element 2.

Such a structure facilitates quick replacement of the reflective elements when generating compound mosaic images, thereby speeding up the process of assembling the decorative panel.

The restraining members 3 are casted integrally with the base 1 by using a casting method based on polymer, such as, high-impact polystyrene, acrylic glass, monolithic polycarbonate.

Figure 10:
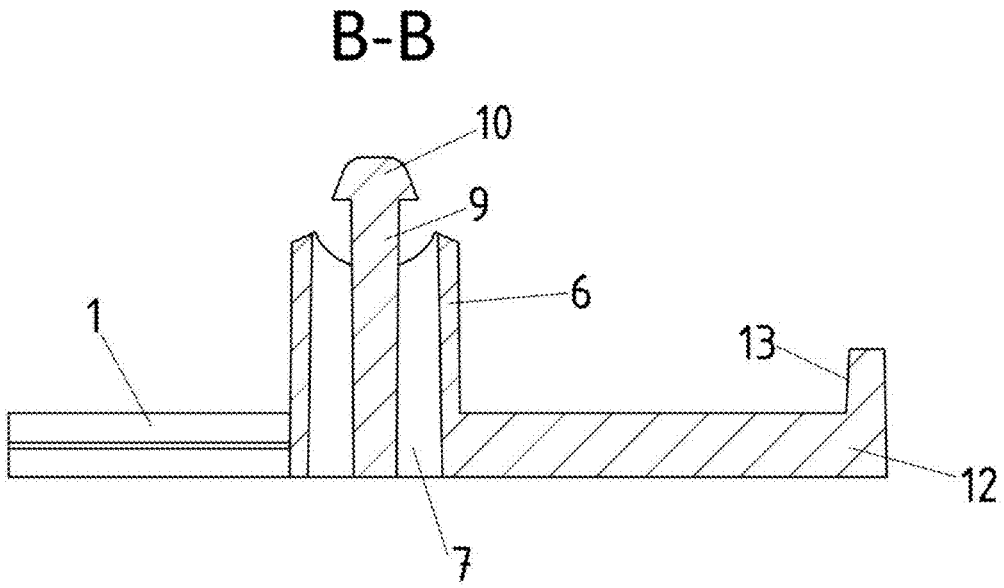
FIG. 10 is a section along line B-B in FIG. 1.

Connection elements 12 which are configured as bars casted integrally with the base are provided on the reverse side of the base 1, 1.1 at the locations of the rods 9 for the movable reflective elements 2 (see FIG. 10). The connection element 12 has a pin 13 at its end.

Figure 11:
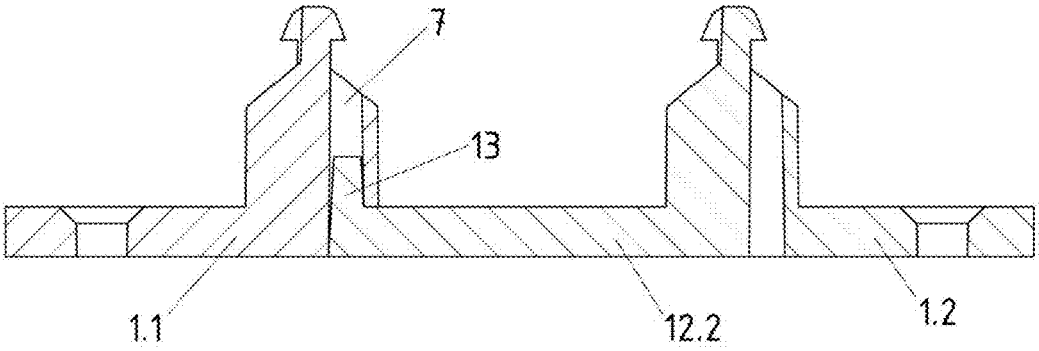
FIG. 11 is a section along line H-H in FIG. 20, which shows a scheme for connecting a module 1.1 and a module 1.2 by using a connection element 12.2 of the module 1.2.

The modules are interconnected according to the "pin-hole" connection principle. The pin 13 of the connection element 12 is rightly installed via a connection slot 16 of the support member 6 in the cavity 17 (see FIG. 11).

Figure 14:
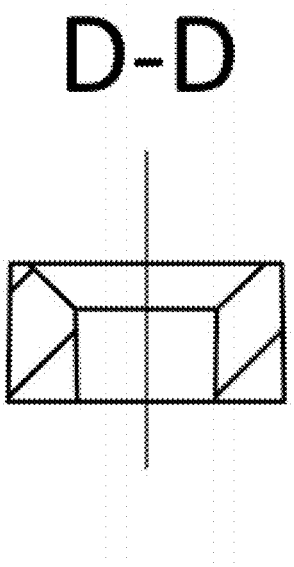
FIG. 14 is a section along line D-D in FIG. 1, which shows a fixing hole 15.

Separate connection bars 14 provided with pins 13 at both ends of the bars may be used to connect the modules (see FIG. 14).

Figure 15:
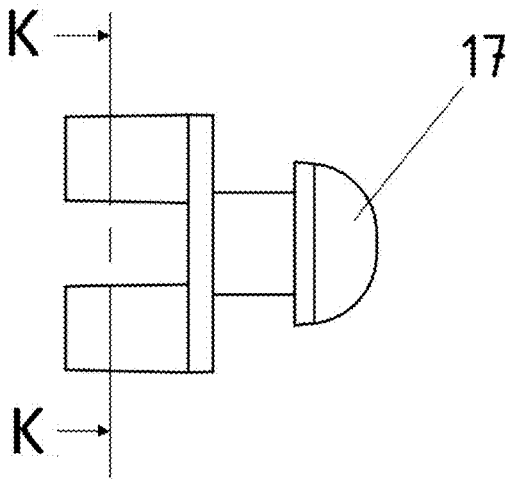
FIG. 15 shows a lock member 17.
Figure 16:
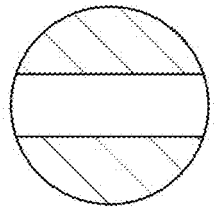
FIG. 16 is a section along line K-K in FIG. 15.

To connect the module 1 with the duplicating base 20, lock members 17 are provided in the panel (see FIGS. 15, 16). The lock members 17 may be inserted in the cavity 7 of the support member in order to fasten the duplicating base. Holes 21 are provided in the duplicating base 20 at places where the base 1 is aligned with the duplicating base 20 (see FIG. 19).

Figure 17:
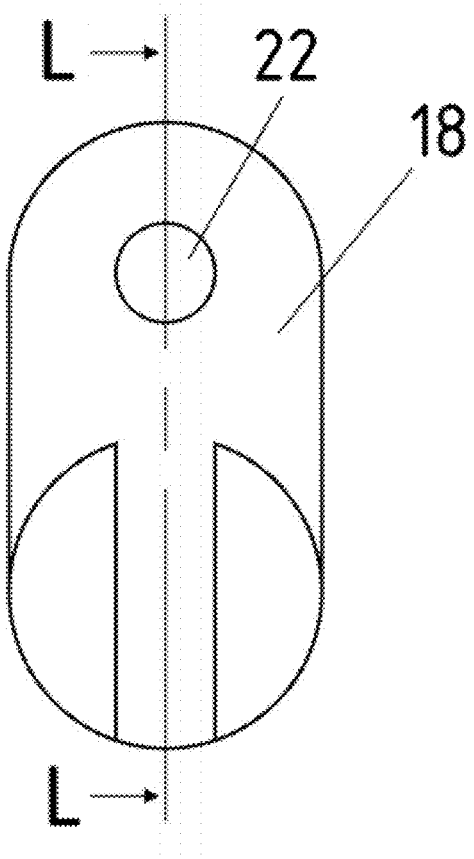
FIG. 17 shows a suspension 18.
Figure 18:
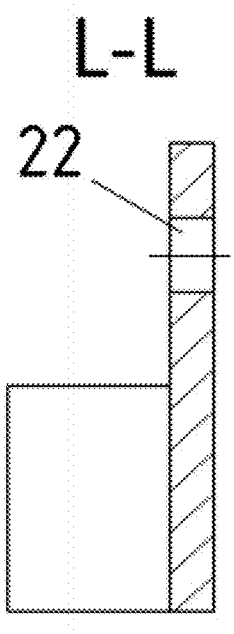
FIG. 18 is a section along line L-L in FIG. 17.

Suspensions 18 are provided to hang the assembled panel (see FIGS. 17, 18). The suspension has a base rightly inserted in the cavity 7 of the support member, and a wire rope used for hanging the decorative panel, for example, in a window display or to any vertical plane, is threaded through a hole 22.

The duplicating base 20 for the panel is a plane having a monochromatic or polychromatic image provided thereon.

Preferably, the duplicating base 20 (see FIG. 19) is made of polymer material. The material which may be used for the duplicating base 20 includes thin films like PVC and PET. The monochromatic or polychromatic image provided on the base 20 duplicates the image generated by the movable reflective elements 2. The base 20 has dimensions equal to external dimensions of the base 1 of the panel. The holes 21 (see FIG. 19) are provided in the duplicating base 20 in order to fasten the lock members 17 (see FIGS. 15, 16) to the base 1.

The holes 21 are positioned in the duplicating base 20 such that, in the assembly, the centers of the holes 21 are aligned with the centers of the lock members 17.

Embodiment 2

Figure 2:
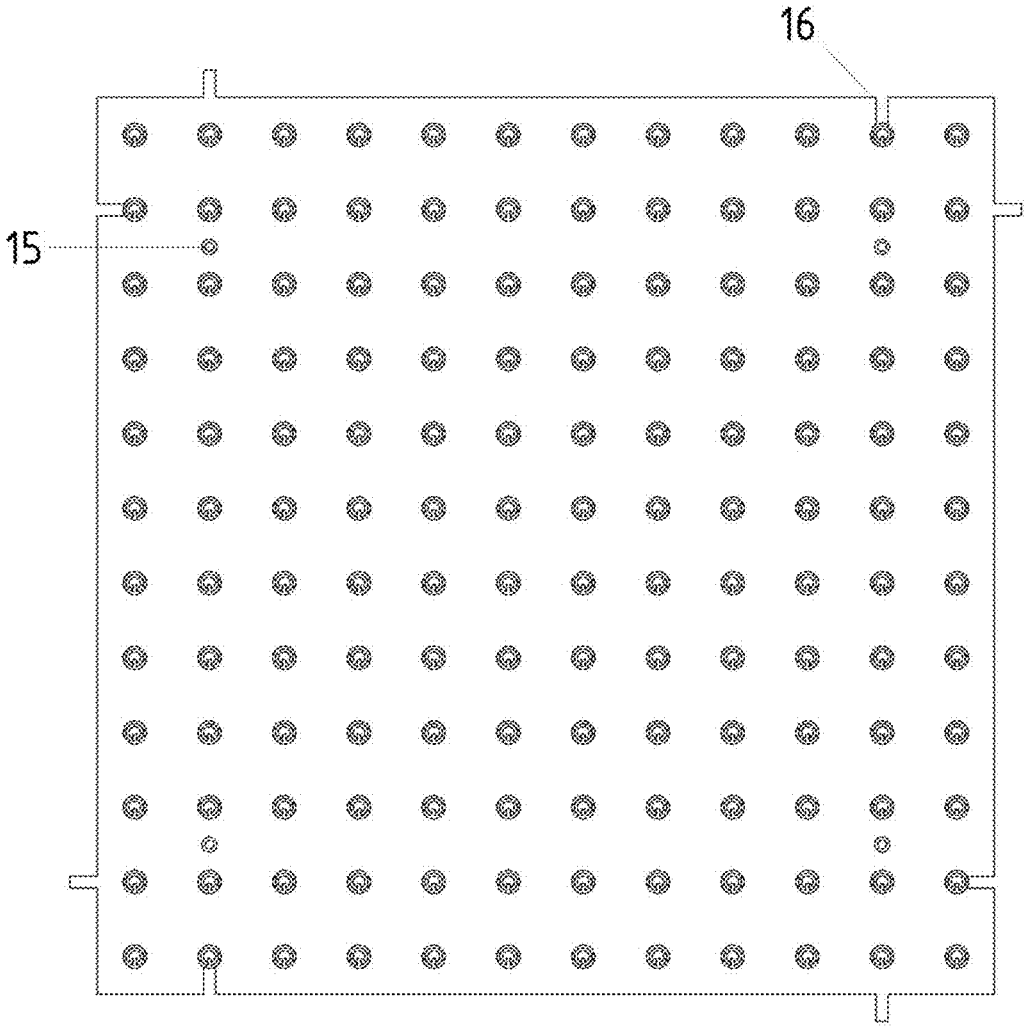
FIG. 2 shows a panel base in the form of a monolithic base according to embodiment 2.

A reflective decorative panel according to embodiment 2 consists of a base 1 that is a solid monolithic base (see FIG. 2) made of transparent polymer material, such as high-impact polystyrene, acrylic glass, monolithic polycarbonate, by means of pressure casting. The base 1 is a module which may be connected to other modules by using connection elements 12 (see FIG. 20). Movable reflective elements 2 (see FIG. 3) are arranged on restraining members 3 of the framework 1 in cantilever fashion with the aid of holes 19. The holes 19 of the movable reflective elements 2 may have any geometric shape, namely: a circle, semi-circle, oval, polygon, etc.

The movable reflective elements 2 are made of biaxially oriented polyester material with thickness 150-200 microns. This material has a high elasticity, a possibility of being subjected to repeated strain, an excellent primary manufacturing memory, and a recoverability of its physical properties. The physical properties, such as thickness, density, linear stiffness, are changed in this material only under high temperatures starting from 200 degrees (see http://new-chemistry.ru/letter.php?n_id=1113).

The restraining members 3 (see FIGS. 4, 6) are arranged on the base 1 and consist of support members 6 having inner longitudinal cavities 7 in which rods 9 with a restraining head 10 for accommodating the movable reflective elements 2 are provided. The rods 9 are spaced apart from or connected to walls of the support member 6 by means of at least one reinforcement rib 8 (see FIGS. 6, 7, 8, 9).

The support members 6 are provided, at edge portions of the base, with connection slots 16 for connecting the modules (see FIGS. 4, 8, 9).

The restraining head 10 used for restraining the movable reflective element 2 from falling is provided on the side of a free end of the rod 9. The restraining head 10 has a frustoconical shape and comprises a vertical slot 11 (see FIGS. 6, 7). The presence of the slot 11 provides a reduction in the weight of both the restraining head and the framework as a whole.

Furthermore, the present author has found that such a shape of the restraining head 10 facilitates quick installation of the movable reflective element 2 on the rod 9, without causing strains and extensions of the reflective elements. This is because the size d of the hole 19 of the movable reflective element 2 (see FIGS. 6, 13) is equal to the size a from the face end of the slot 11 to a diametrically opposite base edge of the restraining head 10, where:

Dk is the diameter of a base of the restraining head;

dk is the diameter of an end portion of the restraining head;

a is the distance from the external circle Dk to the slot 11.

The smaller diameter dk of the outer part of the restraining head is smaller than the size of the hole 19 of the movable reflective element 2. This is done in order to position the workpiece with the perforated reflective elements 2 as accurately as possible with respect to the rods 9 when assembling the decorative panel. The larger diameter Dk of the base of the restraining head 10 serves as a lock member for the movable reflective element 2.

Such a structure facilitates quick replacement of the reflective elements when generating compound mosaic images, thereby speeding up the process of assembling the decorative panel.

The restraining members 3 are casted integrally with the base 1 by using a casting method based on polymer, such as, high-impact polystyrene, acrylic glass, monolithic polycarbonate.

Connection elements 12 which are configured as bars casted integrally with the base are provided on the reverse side of the base 1.1, 1.2 at the locations of the rods 9 for the movable reflective elements 2 (see FIG. 10). The connection element 12 has a pin 13 at its end.

The modules are interconnected according to the "pin-hole" connection principle. The pin 13 of the connection element 12 is rightly installed via a connection slot 16 of the support member 6 in the cavity 17 (see FIG. 11).

Figure 12:
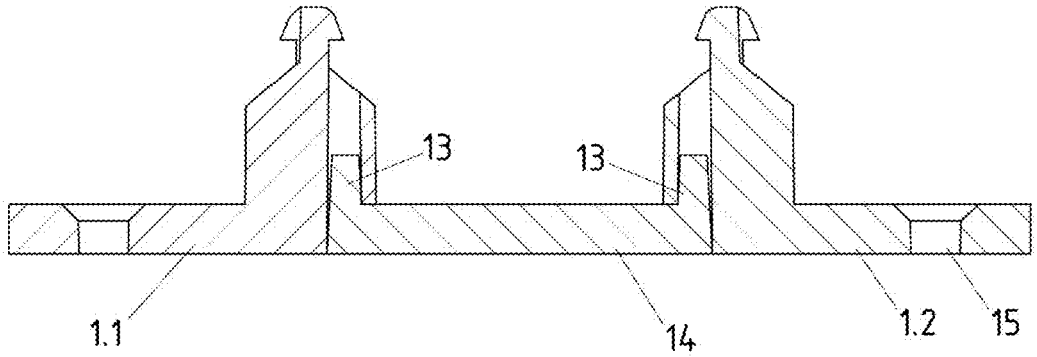
FIG. 12 shows a scheme for connecting the modules 1.1 and 1.2 by a connection bar 14.

Separate connection bars 14 provided with pins 13 at both ends of the bars may be used to connect the modules (see FIG. 12).

To connect the module 1 with the duplicating base 20, lock members 17 are provided in the panel (see FIGS. 15, 16). The lock members 17 may be inserted in the cavity 7 of the support member in order to fasten the duplicating base. Holes 21 are provided in the duplicating base 20 at places where the base 1 is aligned with the duplicating base 20 (see FIG. 19).

Suspensions 18 are provided to hang the assembled panel (see FIGS. 17, 18). The suspension has a base rightly inserted in the cavity 7 of the support member, and a wire rope used for hanging the decorative panel, for example, in a window display or to any vertical plane, is threaded through a hole 22.

The duplicating base 20 for the panel is a plane having a monochromatic or polychromatic image provided thereon.

Preferably, the duplicating base 20 (see FIG. 19) is made of polymer material. The material which may be used for the duplicating base 20 includes thin films like PVC and PET. The monochromatic or polychromatic image provided on the base 20 duplicates the image generated by the movable reflective elements 2. The base 20 has dimensions equal to external dimensions of the base 1 of the panel. The holes 21 (see FIG. 19) are provided in the duplicating base 20 in order to fasten the lock members 17 (see FIGS. 15, 16) to the base 1.

The holes 21 are positioned in the duplicating base 20 such that, in the assembly, the centers of the holes 21 are aligned with the centers of the lock members 17.

Certain Implementation Examples

The present invention is explained further by using certain implementation examples which however are not limitative but clearly demonstrate the feasibility of the invention.

Example 1. A reflective decorative panel according to embodiment 1 comprises a base with restraining members on which reflective elements are arranged in cantilever fashion with the aid of holes. The base is configured as a plastic lattice framework having longitudinal and transverse bearing stripes. The restraining members 3 are casted integrally with the base 1 at the locations of the bearing stripes 4 and 5. The restraining members 3 consist of support members 6 with inner longitudinal cavities 7 in which rods 9 with a restraining head 10 for accommodating the movable reflective element 2 are provided. The rods 9 are connected to the walls of the support member 6 by means of a single reinforcement rib. The restraining head 10 provided on the side of the free end of the rod 9 has a frustoconical shape and comprises a vertical slot 11. The size of the hole of the movable reflective element 2 corresponds to the size from the face end of the vertical slot 11 of the restraining head to the diametrically opposite base edge of the restraining head 10. The size of the external part of the restraining head is less than the size of the hole 11 of the movable reflective element 2.

Connection elements 12, which are configured as bars each casted integrally with the base and provided with a pin 13 at the end of the connection element 12, are provided on the reverse side of the base of the panel at the location of the rods 9. The support members 6 are provided, at the edge portions of the base, with connection slots 16 for connecting the modules.

Example 2. A reflective decorative panel according to embodiment 2 comprises a solid monolithic base (see FIG. 2) made of transparent high-impact polystyrene by means of pressure casting. The base 1 is a module that may be connected to other modules by connection elements 12. Restraining members 3 (FIG. 3), on which movable reflective elements 2 (see FIG. 3) are arranged in cantilever fashion with the aid of holes 19, are provided on the base 1.

The restraining members 3 are casted integrally with the base 1 and consist of support members 6 with inner longitudinal cavities 7 in which rods 9 with a restraining head 10 for accommodating the movable reflective element 2 are provided. The rods are connected to the walls of the support member 6 by means of a single reinforcement rib. The restraining head 10 provided on the side of the free end of the rod 9 has a frustoconical shape and comprises a vertical slot 11. The size of the hole of the movable reflective element 2 corresponds to the size from the face end of the vertical slot 11 of the restraining head to the diametrically opposite base edge of the restraining head 10. The size of the external part of the restraining head is less than the size of the hole 11 of the movable reflective element 2.

Connection elements 12, which are configured as bars each casted integrally with the base and provided with a pin 13 at the end of the connection element 12, are provided on the reverse side of the base of the panel at the location of the rods 9. The support members 6 are provided, at the edge portions of the base, with connection slots 16 for connecting the modules.

Example 3. The reflective decorative panel according to any of Examples 1 or 2, wherein the rods are connected to the walls of the support member 6 by means of two reinforcement ribs.

Example 4. The reflective decorative panel according any of Examples 1 or 2, wherein the rods are connected to the walls of the support member 6 by means of three reinforcement ribs.

Example 5. The reflective decorative panel according to any of Examples 1 or 2, wherein the separate connection bars 14 provided with the pins 13 at both ends of the bars are used to connect the modules.

Example 6. The reflective decorative panel according to any of Examples 1 or 2, comprising a duplicating base that is a plane having a monochromatic image provided thereon.

Example 7. The reflective decorative panel according to any of Examples 1 or 2, comprising a duplicating base that is a plane having a polychromatic image provided thereon.

Example 8. The reflective decorative panel according to any of Examples 1 or 2, wherein lock members are provided in the panel to connect the module with a duplicating base, the lock members being inserted in the cavity of the support member in order to fasten the duplicating base. Holes are provided in the duplicating base at places where the base is aligned with the duplicating base. Suspensions are provided to hang the assembled panel.

Assembly

The base 1 of the panel is manufactured, by pressure casting, as the framework (embodiment 1) or monolithic panel (embodiment 2) that is casted integrally with the restraining members 3.

Figure 21:
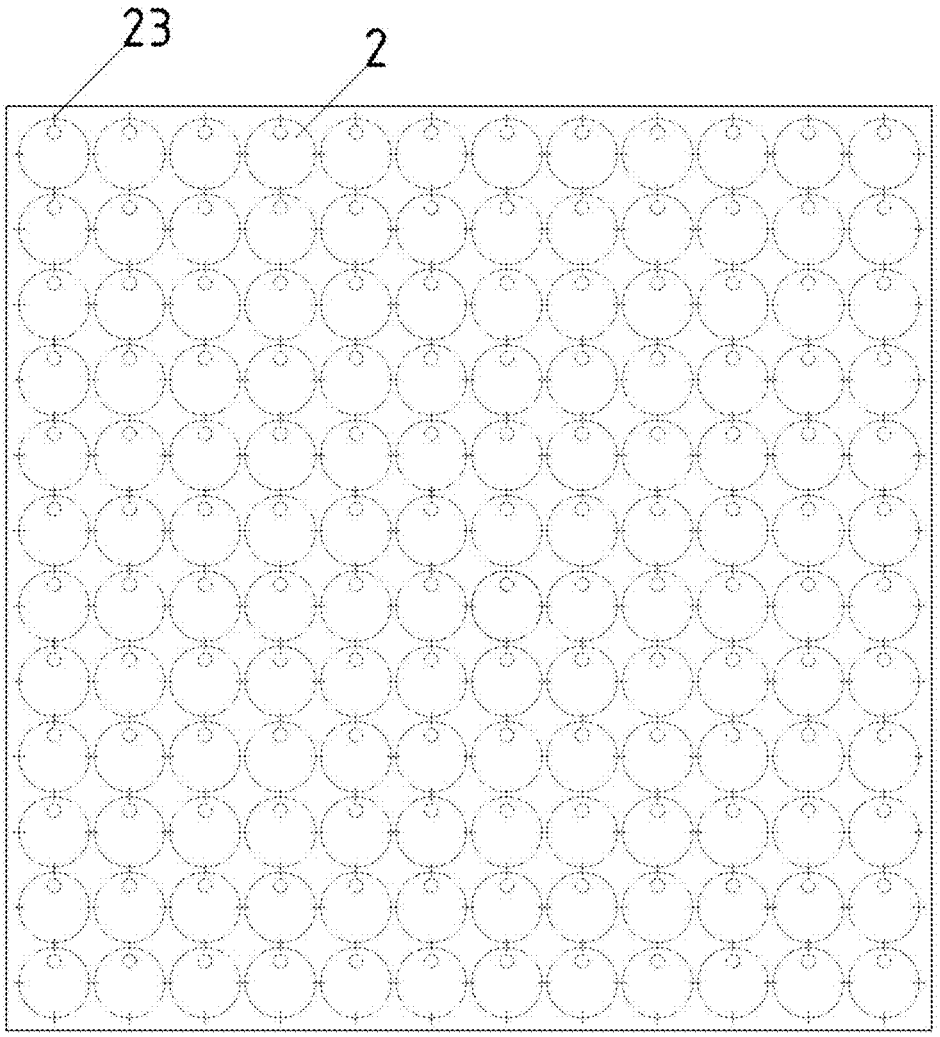
FIG. 21 shows a workpiece with movable reflective elements.
Figure 22:
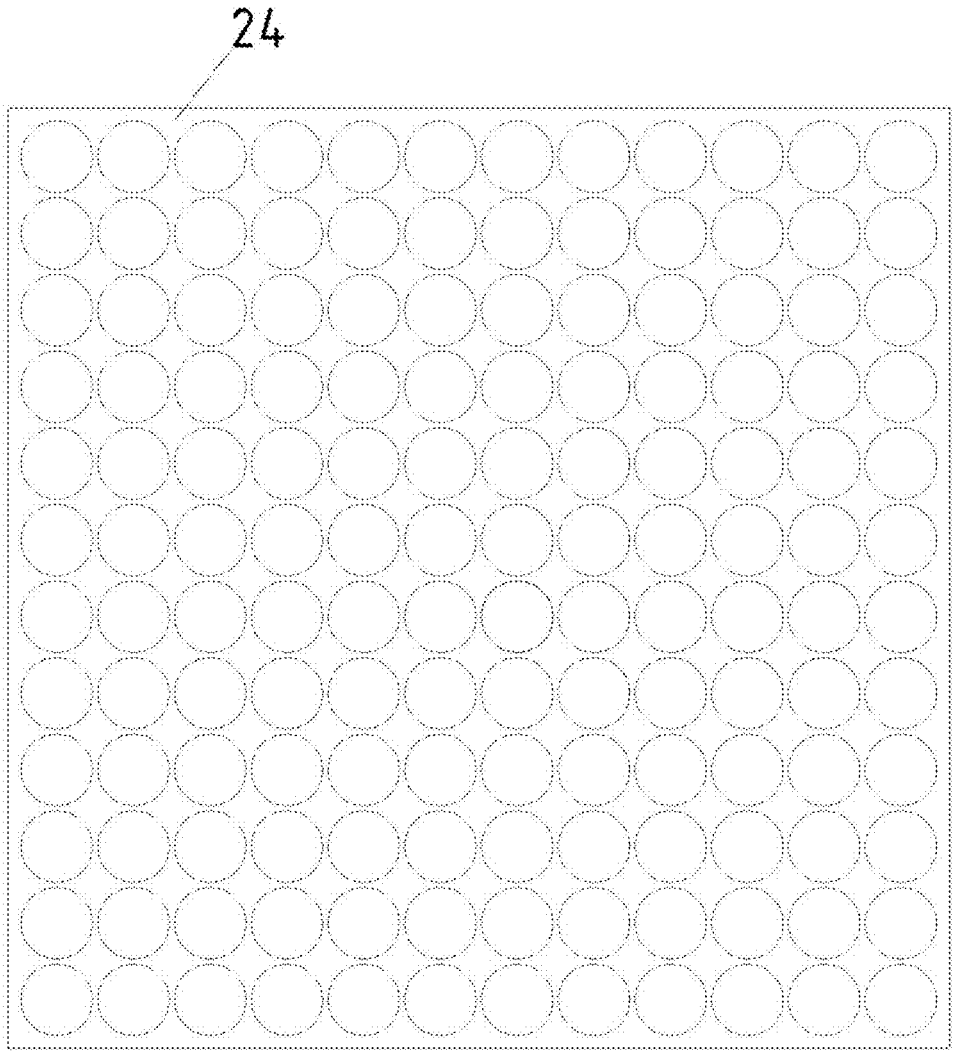
FIG. 22 shows flash.

The workpiece for the panel (see FIG. 21) is formed by means of stamping, the workpiece being a group of the movable reflective elements 2 configured as the whole image or an image part according to a design. The workpiece comprises flash 24 caused by the extrusion of excess material from an open die or insufficient material penetration by means of stamped blades.

Figure 19:
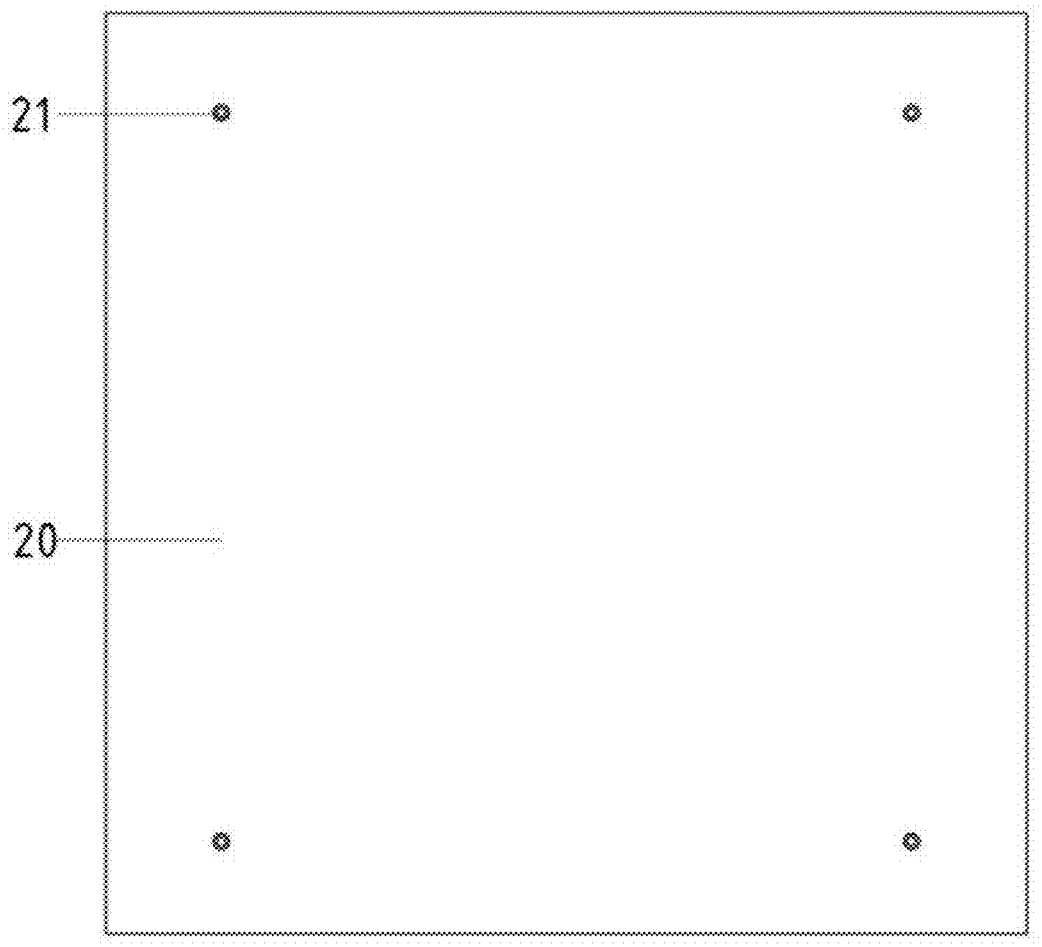
FIG. 19 shows a duplicating base.

After the stamping, the workpiece consists of the following two parts: the group of the movable reflective elements which are interconnected by vias 23 of thickness 150-450 microns (on the four sides of the reflective element), and the flash 24 (see FIGS. 18, 19).

The vias are a material part which is not cut through and used for fastening workpieces together and for retention of waste on the sheet. The assembly process consists of the following steps:

1. The modules of the base are optionally interconnected by the connection elements into the whole panel.
2. The workpiece is positioned relative to the centers of the restraining heads 10, while aligning the hole 19 of the movable reflective element and the restraining head 10, and the group of the movable reflective elements 2 are put on the group of the rods 9 of the decorative panel.
3. After the workpiece is put via the restraining head 10 on the rods 9, the remaining flash 24 is removed from the workpiece by easily pulling it away from the reflective elements 2 due to the fact that the flash and the reflective elements have interconnections as the vias usually at four places, the vias having a thickness of 150-450 microns depending on the workpiece density.

The light solid framework is installed according to a design by hanging or fastening rigidly or pivotally it to supporting constructions with the aid of the suspensions 18 (see FIGS. 17, 18). The base of the suspension is rightly inserted in the cavity 7 of the support member, and a wire rope used for hanging the decorative panel, for example, in a window display or to any vertical plane, is threaded through a hole 26.

The movable reflective elements 2 are freely hung by the rods 9 and restrained by the heads 10 from falling. The presence of the slot in the head 10 not only reduces the weight of the member but also facilitates quick replacement of the reflective elements in case of their damage or when generating compound mosaic images, thereby speeding up the process of assembling the decorative panel.

The all-cast framework of the reflective decorative panel is lighter than the framework of the decorative panel disclosed in RU182951 because the cantilever members are all-cast and have support members each with the inner longitudinal cavity in which the rod with the restraining head for accommodating the movable reflective element is provided, and the restraining head comprising the vertical slot additionally reducing the weight of the whole item.

The weight reduction reduces the materials consumption of the item and the price of manufacture.

INDUSTRIAL APPLICABILITY

The reflective decorative panel finds application for outdoor street party accessories, decorations and equipment of theaters or television, volumetric objects and facilities for games, entertainment and public events, signboards, display stands, advertisement media and other decorative items.

What is claimed is:

1. A reflective decorative panel comprising a base implemented as a module of the panel, the base having restraining members on which movable reflective elements are arranged in cantilever fashion by using holes, wherein the base is configured as a plastic lattice framework having longitudinal and transverse bearing stripes, and the restraining members comprise rods each having a restraining head and used for accommodating the reflective element, the restraining head having a tapered shape towards its free end, and the restraining members being casted integrally with the base on the bearing stripes, wherein, at edge portions of the base, support members are provided with connection slots for connecting modules, characterized in that the restraining members comprise the support members, and the support members have inner longitudinal cavities in which the rods with the restraining heads are provided, wherein the rods are spaced apart from or connected to walls of the support members by means of at least one reinforcement rib, and wherein the restraining head comprises a vertical slot used for putting on the movable reflective element, the movable reflective element having a hole whose size is equal to a size from a face end of the slot to a diametrically opposite base edge of the restraining head.

2. The reflective decorative panel of claim 1, characterized in that the size of the tapered part of the restraining head is less than the size of the hole of the movable reflective element.

3. The reflective decorative panel of claim 1, characterized in that connection elements which are configured as bars each casted integrally with the base and provided with a pin at the end of the connection element are provided on the reverse side of the base of the panel at the location of the rods.

4. The reflective decorative panel of claim 1, characterized in that the support members are provided, at the edge portions of the base, with connection slots for connecting the modules.

5. The reflective decorative panel of claim 1, characterized in that it comprises a duplicating base that is a plane having a monochromatic or polychromatic image provided thereon.

6. The reflective decorative panel of claim 1, characterized in that it comprises lock members inserted in the cavity of the support element to fasten a duplicating base.

7. The reflective decorative panel of claim 1, characterized in that it comprises suspensions for hanging the assembled panel to a vertical plane.

8. A reflective decorative panel comprising a base implemented as a module of the panel, the base having restraining members on which reflective elements are arranged in cantilever fashion by using holes, wherein the base is made of solid monolithic plastic, and the restraining members comprise rods each having a restraining head and used for accommodating the reflective element, the restraining head having a tapered shape towards its free end, and the restraining members being casted integrally with the base, characterized in that the restraining members comprise the support members, and the support members have inner longitudinal cavities in which the rods with the restraining heads are provided, wherein the rods are spaced apart from or connected to walls of the support members by means of at least one reinforcement rib, the restraining head comprising a vertical slot used for putting on the movable reflective element, the movable reflective element having a hole whose size is equal to a size from a face end of the slot to a diametrically opposite base edge of the restraining head.

9. The reflective decorative panel of claim 8, characterized in that the size of the tapered part of the restraining head is less than the size of the hole of the movable reflective element.

10. The reflective decorative panel of claim 8, characterize in that connection elements which are configured as bars each casted integrally with the base and provided with a pin at the end of the connection element are provided on the reverse side of the base of the panel at the locations of the rods of the restraining head.

11. The reflective decorative panel of claim 8, characterized in that the support members are provided, at the edge portions of the base, with connection slots for connecting the modules.

12. The reflective decorative panel of claim 8, characterized in that it comprises a duplicating base that is a plane having a monochromatic or polychromatic image provided thereon.

13. The reflective decorative panel of claim 8, characterizing in that it comprises lock members inserted in the cavity of the support element to fasten a duplicating base.

14. The reflective decorative panel of claim 8, characterized in that it comprises suspensions for hanging the assembled panel to a vertical plane.

* * * * *